United States Patent [19]

Grasson

[11] 4,184,306

[45] Jan. 22, 1980

[54] PACKAGING METHOD AND APPARATUS

[75] Inventor: John L. Grasson, Brecksville, Ohio

[73] Assignee: Gould Inc., Rolling Meadows, Ill.

[21] Appl. No.: 857,637

[22] Filed: Dec. 5, 1977

[51] Int. Cl.[2] ..... B65B 5/02; B65B 5/08; B65B 5/10; B65B 5/12

[52] U.S. Cl. ..... 153/240; 53/244; 53/253; 29/772

[58] Field of Search ..... 53/167, 238, 240, 244, 53/250, 253, 391, 558, 559, 527; 29/772, 773

[56] References Cited

U.S. PATENT DOCUMENTS

| | | | |
|---|---|---|---|
| 3,531,909 | 10/1970 | Edelbalk | 53/253 X |
| 3,660,962 | 5/1972 | Bliss et al. | 53/453 X |
| 4,002,008 | 1/1977 | Grasson | 53/527 |

FOREIGN PATENT DOCUMENTS

| | | | |
|---|---|---|---|
| 2200947 | 7/1973 | Fed. Rep. of Germany | 53/240 |

*Primary Examiner*—Horace M. Culver

*Attorney, Agent, or Firm*—Russell E. Baumann; Edward E. Sachs

[57] ABSTRACT

A new packaging method and apparatus for positively nesting at least one workpiece in a base member comprised of permanently deformable material such as cellular urethane foam. The base member is electrostatically neutralized, cleaned and then moved onto a rotating table-like arrangement defining a circular work path and which is adapted to be selectively indexed between a plurality of individual work stations. Disposed above the work path and selectively movable toward and away therefrom is a frame member. This frame member advantageously includes individual work performing means at spaced intervals therearound adapted to be placed in operative association with selected ones of the work stations in order to achieve the desired workpiece nesting in the base member. These work performing means may facilitate various aligning, performing, compression nesting and ejection operations in any sequence which may be desired and/or necessary to accommodate different workpiece types and styles. The packaging method and apparatus allow for efficient, reliable packaging even when nesting of limited strength workpieces or a plurality of workpieces of varying dimensional sizes is required. Feed and removal mechanisms operably communicating with the work path permit sequential processing and nesting with regard to a continuous supply of base members.

28 Claims, 10 Drawing Figures

PACKAGING METHOD AND APPARATUS

BACKGROUND OF THE INVENTION

This invention pertains to the art of packaging and more particularly to nesting individual workpieces or articles in a base or pad member.

The invention is particularly applicable to the nesting of limited strength or deformable items and to nesting a plurality of workpieces of varying dimensional sizes such as engine bearings or the like in a deformable base member and will be described with particular reference thereto. However, it will be appreciated by those skilled in the art that the invention has far broader applications and may be equally applicable to use for nesting enumerable other articles, workpieces or the like in a deformable base member.

Heretofore, the packaging of limited strength items such as medicine bottles or the like has often been done in preformed rigid foam shell halves generally comprised of upper and lower shell halves. The shell halves are expensive to produce, must be specially ordered to size in advance and then inventoried. The cost associated with the shell halves greatly increase the total packaging costs from material, storage and manpower standpoints. Also, if different sized medicine bottles or the like are to be involved, entirely new premolded shell halves are required which greatly adds to packaging costs.

In the case of nesting a plurality of workpieces having various sizes, the packaging has either been done by hand requiring the use of special cartons and dunnage for separating, cushioning and so on or has been done automatically in a manner such as described in the commonly assigned U.S. Pat. No. 4,002,008. However, using the arrangement disclosed in this commonly assigned patent requires a separate run and handling for each of the different workpiece sizes. Thus, neither of the aforementioned packaging methods has been considered optimum from speed and cost points of view.

Accordingly, it is considered desirable to eliminate the necessity of hand packaging or the need for multi-run operations and to substantially automatically perform all the packaging or nesting steps in such an operation. In this regard, it is considered particularly desirable that all the packaging or nesting steps be completed on one single run through an apparatus and that human operators merely institute the initial process by loading or handling the workpieces which are to be nested in the base members. Such method and apparatus would greatly reduce the total number of operators required to obtain increased production output, eliminate the need for premolded shell halves or at least substantially all of the dunnage required in present manual packing processes, reduce the floor space heretofore required to inventory the special shell halves or dunnage and reduce the floor space required to accommodate the overall packaging or nesting operation.

The present invention contemplates a new and improved method and apparatus which is particularly applicable for nesting limited strength and deformable items or workpieces and for nesting a plurality of items or workpieces of various dimensional characteristics in a deformable base member. The present invention overcomes all of the above referred to problems and others and provides a new and improved method and apparatus for packaging which meet the above defined desirable features for an automated packaging system. The new and improved method and apparatus are also simple in design, economical to use, compact insofar as floor space utilization is concerned and readily adapted to use in a plurality of environments for packaging any number of different pieces or articles.

BRIEF DESCRIPTION OF THE INVENTION

In accordance with the present invention, there is provided apparatus for nesting at least one workpiece in a base member which is comprised of a permanently deformable material generally having opposed top and bottom faces and a predetermined thickness. The apparatus includes means for defining a work path which supports the base member and also includes means for selectively moving the base member between work stations disposed at spaced intervals along the work path. Work performing means adjacent the work path at least at selected ones of the work stations are adapted to be selectively moved into and out of a work performing relationship with at least one of the base member and workpiece for performing the necessary work operations thereon to ultimately obtain the desired nesting of the workpiece in the base member. Means are also provided for moving the work performing means into and out of the work performing relationship at least when the base member is located in a work station having one of the work performing means associated therewith.

In accordance with another aspect of the present invention, a feeding mechanism is provided for sequentially and separately introducing at least additional base members onto the work path at a first or initial work station when each preceeding base member has been moed from the first work station to the next succeeding work station.

In accordance with another aspect of the present invention, an exit or removal mechanism is provided for sequentially moving the base members and nested workpieces away from the work path at a preselected one of the work stations spaced along said work path from the initial work station.

In accordance with yet another aspect of the present invention, the at least one workpiece is nested in the base member from the top face toward the bottom face and each work performing means is adapted to be moved from a first non-contacting position into a second contacting position by the moving means. In the contacting position, the work performing means engages at least one of the workpiece and the base member so as to perform an operational step toward realizing the final nested relationship therebetween. The work performing means may comprise a compression means, forming die means, cutting die means or any number of other implements required to accommodate the specifics of the nesting operation. The apparatus is such that the work performing means may be selectively installed in operative association with selected ones of the work stations to accommodate different nesting operations for a particular workpiece/base member combinations and relationships.

In accordance with a more limited aspect of the present invention, the feeding and removal mechanism may include means for selectively treating the base member and/or the final nested arrangement. Such treating means may advantageously include static removal, vacuuming and coating.

In accordance with still a further aspect of the present invention, there is provided a method for nesting at least one workpiece in a base member which is comprised of a permanently deformable material generally having opposed top and bottom faces and a predetermined thickness. The first step in the method comprises moving the base member along a work path having a plurality of work stations at spaced intervals therealong, including an initial and an exit work station. The next step comprises placing the workpiece on the base member top face at one of the work stations for movement with the base member along the work path toward the exit work station. The next step includes causing a nesting operation to be performed for nesting the workpiece in the base member from the top face toward the bottom face thereof at least at a work station between the one and the exit work stations. Finally, the method includes the step of removing the base member and nested workpiece from the work path.

In accordance with yet a further aspect of the method, there is included the steps of sequentially introducing additional base members onto the work path at the initial work station; repeating the steps of moving, placing and causing for each of the base members and the workpiece associated therewith; and, sequentially removing each of the base members and the associated nested workpiece from the work path as they are moved into the exit work station.

The principal object of the present invention is the provision of method and apparatus for systematically nesting workpieces or articles in a deformable base member.

Another object of the present invention is the provision of method and apparatus for such nesting which are simple, reduce labor and material costs and which reduce the floor space required for the packaging or nesting operations.

Still another object of the present invention is the provision of method and apparatus for packaging or nesting articles or workpieces in a deformable base material in a singl work path pass.

Yet another aspect of the present invention is the provision of method and apparatus for packaging or nesting limited strength articles and articles of varying dimensional characteristics in a deformable base member.

Other objects and advantages to the present invention will become apparent to those skilled in the art upon a reading and understanding of the following specification.

BRIEF DESCRIPTION OF THE DRAWINGS

The invention may take physical form in certain parts and arrangements of parts, a preferred and alternative embodiments of which will be described in detail in this specification and illustrated in the accompanying drawings which form a part hereof and wherein.

DESCRIPTION OF THE PREFERRED AND ALTERNATIVE EMBODIMENTS

Figure 1:
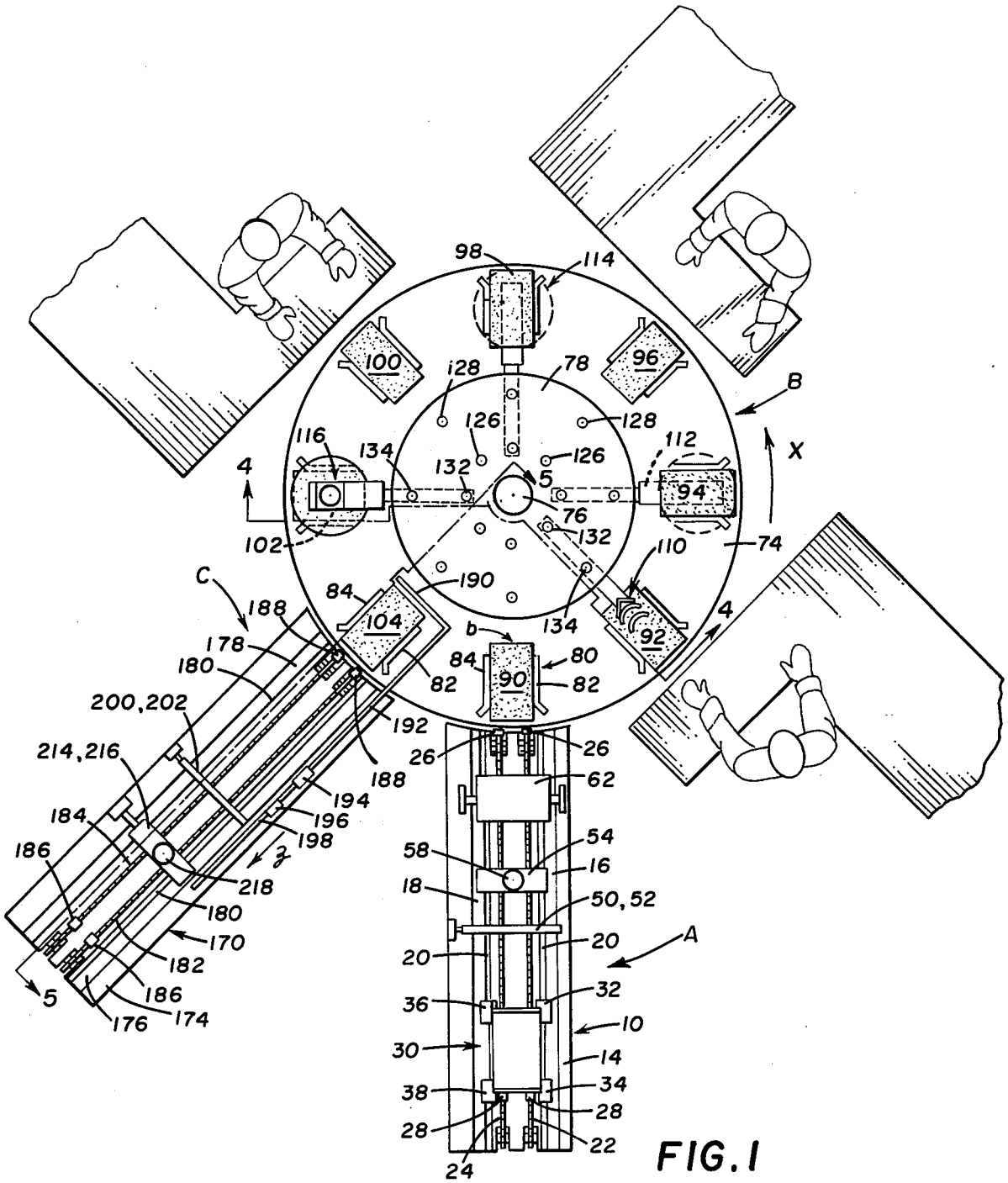
FIG. 1 is a plan view of apparatus incorporating the concepts of the present invention.

Referring now to the drawings wherein the showings are for purposes of illustrating the preferred and alternative embodiments of the invention only and not for purposes of limiting same, the FIGURES show a base media infeed unit A disposed radially adjacent a generally circular indexing table B and a base media removal unit C which is also disposed radially adjacent the indexing table.

Figure 2:
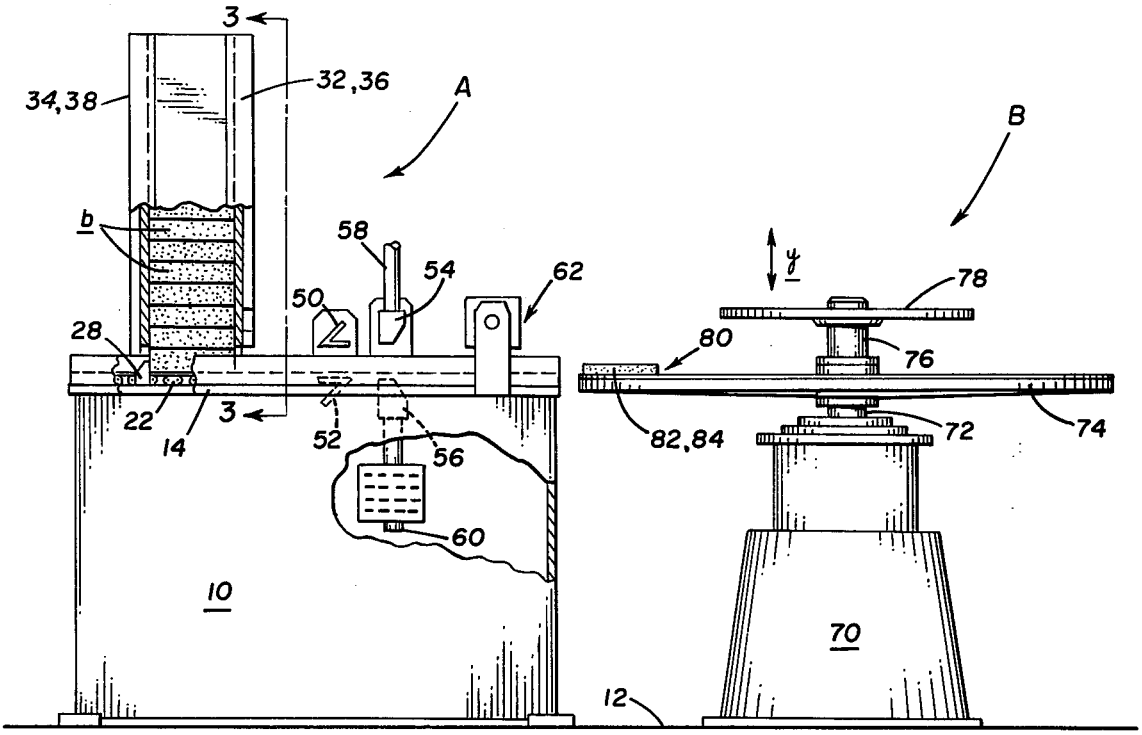
FIG. 2 is a side elevational view of the infeed unit and indexing table shown in FIG. 1 with the work performing means removed from the indexing table for ease of illustration.
Figure 3:
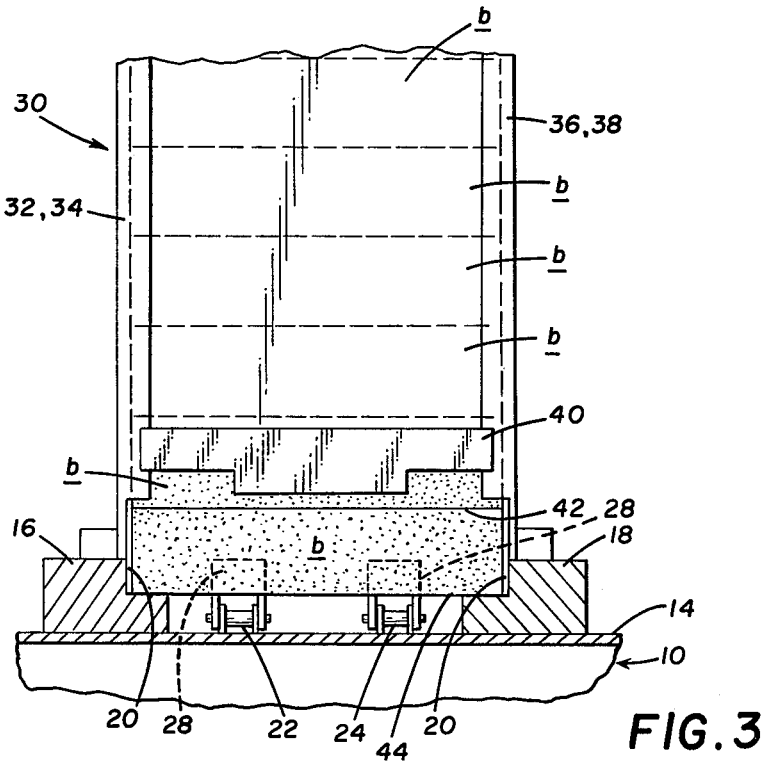
FIG. 3 is a cross-sectional view taken along lines 3—3 of FIG. 2.

More particularly, and with reference to FIGS. 1, 2 and 3, infeed unit A is comprised of an enclosed frame/-cabinet unit generally designated 10 which rests on the floor 12 or some other convenient base area. In the preferred arrangement, the frame/cabinet unit is preferably constructed of tubular steel with appropriate sheet siding to include access doors (not shown) for cleaning of dust particle residue from a vacuum hopper housed therein as will be more fully appreciated hereinafter. Frame/cabinet 10 includes a planar top surface or wall 14 adapted to receive and support additional infeed unit components.

More particularly, a pair of elongated side guides 16,18 are mounted to top surface or wall 14 to support and allow infeeding of individual base members in a manner to be described. These side guides are transversely spaced apart from each other and, in a longitudinal direction, extend radially outward from the indexing table B coextensive with the infeed unit itself. Each side guide includes an L-shaped groove 20 extending longitudinally therealong at the inside edge thereof in a manner such that they are opposed to each other and cooperatively define a base member support channel. The side guides themselves may be adjustably mounted to top surface or wall 14 by any convenient means (not shown) to facilitate ready transverse adjustment therebetween to vary the width of the channel for accommodating different base member sizes.

A pair of continuous drive chains 22,24 extend for a portion of their length along top wall 14 between side guides 16,18 in a parallel spaced apart relationship with each other and with the base member support channel. Drive chains 22,24 may comprise any type of chain conventionally used in conveyor type systems and each chain is continuous in nature adapted to be received over end sprockets, intermediate sprockets and the like (not shown) to be selectively driven by a drive motor (not shown) as is conventional in conveyor type systems. Since the basic elements of chain conveyor apparatus are deemed known in the art, they are not shown or described in any detail herein. Disposed at spaced intervals along drive chains 22,24 are a plurality of chain dog pairs. Two such pairs 26,28 are shown and are spaced along the drive chains at intervals such that when dogs 26 are spaced closely adjacent the forward edge of unit A at indexing table B, dogs 28 will be spaced adjacent the rear end of unit A for reasons and purposes which will be described. Although two sets of chain dogs 26,28 have been shown, additional sets may be necessitated by the precise length and drive unit arrangement utilized for the chains. However, such modifications do not affect the overall scope of the present invention.

With particular reference to FIG. 3, the relative dimensioning between side guides 16,18, drive chains 22,24 and chain dog pairs 26,28 can be more readily appreciated. In FIG. 3, the support channel defined by opposed L-shaped grooves 20 in the side guides supports a base member b in a spaced relationship from the outer surface of planar top or wall 14. This spaced relationship is such that drive chains 22,24 may freely pass between the bottom face of base member b and planar top surface 14. Moreover, chain dog pairs 26,28 affixed to the drive chains are mounted and dimensioned such that they will extend outwardly from the drive chains and upwardly past the lower face of a base member b resting in the support channel in order to selectively move the base member along the channel.

A base member magazine generally designated 30 in FIGS. 1, 2 and 3 is disposed toward the rear area of infeed unit A. This magazine is designed to allow constant automatic feeding of individual base members onto the channel and then toward the indexing table itself. The magazine is preferably comprised of elongated angle iron corner defining members 32,34,36 and 38. Members 32,34 are physically associated with side guides 16 and members 36,38 are physically associated with side guides 18. These members are mounted such by convenient means (not shown) which will facilitate the relative adjustments therebetween to accommodate various base member lengths and widths. A stop member generally designated 40 in FIG. 3 spans members 32,36 to facilitate movement of one base member b at a time from the magazine along the support channel.

In the preferred arrangement of the present invention, base members b are comprised of block-like members constructed or shaped from a cellular urethane foam material to have opposed parallel top and bottom faces 42,44 with a generally constant thickness therebetween. The base members may be conveniently precut to a particular dimensional configuration for accommodating particular desired nesting arrangements and then simply stacked into magazine 30 for subsequent sequential feeding into the system. The overall operation of the system with regard to base members b and workpieces to be nested will be described in greater detail hereinafter.

While a cellular urethane foam construction is preferred, the base members could be formed of many other permanently deformable materials such as cellular polystyrene or the like without in any way departing from the overall intent or scope of the invention. However, because of the compressive forces involved, it has been found particularly advantageous to use a material in which the cells do not just collapse or fracture when deflected during compression. Rather, the material is desirably such that the heavily loaded cells are crushed and permanently deformed while those cells which are loaded to a lesser extent yield elastically and attempt to return to their original position and size. These cells thus act as springs or grippers to hold and retain the workpieces. Moreover, such material will "grow" slightly with age to thereby more tightly hold the workpieces during shipment. Cellular urethane foam meets these particular desirable criteria.

With reference to FIGS. 1 and 2 and spaced fowardly of magazine 30 toward indexing table B are upper and lower static elmination bars 50,52. These bars may be conveniently mounted to frame/cabinet 10 by convenient bracket means and the elimination bars themselves may comprise commercially available static elimination bars such as those marketed by Minnesota Mining & Manufacturing Co. under Model No. 210. The static elimination bars 50,52 are mounted or adjusted such that bar 50 is disposed approximately ½" above top face 42 of those base members b being processed. Static eliminator bar 52 is similarly disposed approximately ½" from the bottom face 44. Since the thickness or distance between face member faces 42,44 may vary between packaging jobs it is desirable to have the mounting arrangements for the static elimination bars permit some latitude in adjusting relative transverse distance between them.

With continued reference to FIGS. 1 and 2 and forwardly spaced from the static elimination bars are upper and lower vacuum heads 54,56. These vacum heads are conveniently mounted in operative relationship with the support channel along which base members b will pass and may be comprised of commercially available nozzle heads and dust collector systems. A vacuum tube 58 is connected to upper vacuum head 54 and a vacuum tube 60 is connected to lower vacuum head 56 with both vacuum tubes 58,60 communicating with or being disposed inside of frame/cabinet 10. Thus, the enclosure acts as a dust collector area which may be periodically emptied and cleaned.

Forwardly adjacent the vacuum heads is a coating applicator station generally designated 62 in FIGS. 1 and 2. This station facilitates application of a liquid coating to at least top face 42 of the base members as they pass therebeneath. Although the coating applicator structure may take many forms without in any way departing from the overall intent or scope of the present invention, the preferred arrangement contemplates utilization of the so called three roll coating system. Moreover, appropriate controls can be provided to allow selective coating of the base members when and if such coating is desired. Typically, the coatings would comprise protective coatings compatible with and for the base member and base member material.

Indexing table B including an enclosed frame 70 resting on the floor or other base 12 and which houses a drive mechanism facilitating both horizontal rotary and reciprocal vertical movement. A wide range of sizes and types of such indexing tables are commercially available although the preferred arrangement of the present invention utilizes a rotary transfer machine with auxiliary vertical motion shaft. Since indexing tables per se are known in the art and commercially available, the drive mechanism therefor housed within enclosed frame 70 need not be discussed in any great detail to permit those skilled in the art to appreciate the present invention. The drive mechanism is operably associated with a rotate shaft 72 protruding outwardly from the upper end of closure 70 and has a circular table 74 operably affixed thereto at its center area with the table having a horizontal disposition. This facilitates driving rotation of the table in a horizontal plane in direction x as viewed in FIG. 1. Table 74 defines a work path and as best shown in FIG. 2, has the top surface thereof substantially level with the path of travel for base members b along infeed unit A. Although the diameter of table 74 may vary to accommodate a particular operation, available table diameters of 48" or 72" are preferably contemplated.

Indexing table B also includes a vertical lift or movement shaft 76 coaxial with rotate shaft 72. Affixed to shaft 76 adjacent the uppermost end thereof is a generally circular table like frame 78 adapted to have a plurality of work performing means operably affixed thereto as will be described. In the preferred arrangement, vertical lift or movement haft 76 is provided with approximately 3" of vertical movement, although the inventive concepts herein involved could also be successfully practiced when using indexing tables having different operational and dimensional characteristics. The furthest spaced apart relationship between table 74 and frame 78 is hereinafter referred to as the first or normal position and the closest spaced apart relationship between them is referred to as the second or work performing position. The vertical movement of shaft 76 is generally designated y in FIG. 2. The diameter of circular frame 78 is less than that of table 74 and for ease of illustration in FIG. 2, no work performing means are shown as installed on frame 78. It should be understood that table 74 only has rotational movement and that frame 78 only has reciprocal movement and that cam type drive arrangements are typically employed to achieve this movement.

With continued reference to FIGS. 1 and 2, a plurality of base member retaining areas generally designated 80 are spaced generally peripherally around the upper surface of circular table 74. Each base member retaining area is defined by a pair of adjustable side plates 82,84 generally radially disposed on the table. Side plates 82,84 of each area 80 are transversely adjustable relative to each other by convenient means (not shown) in order to permit the accommodation of different base member sizes and styles. As described herein and as best shown in FIG. 1, circular table 74 includes eight (8) base member retaining areas 80 with each such retaining area defining a work station which is rotated from an initial position to a final position during operation of the apparatus.

As particularly shown in FIG. 1, the base member retaining areas comprise an initial work station 90 and then subsequent work stations 92,94,96,98,100,102 in direction x leading to an exit or removal work station 104. As will become apparent hereinafter, it is possible to use any number of these eight work stations during a packaging operation or to even vary the number of such work stations which are provided in the first instance. It should again be noted that rotation of table 74 is in the direction x in FIG. 1 and that each base member retaining area moves between each of the work stations as the table is rotated.

Work performing means of any number, type and style are advantageously operably mounted relative to frame 78 to accomplish the desired article or workpiece nesting in base members b. Even though any number, type and style of such work performing means may be employed, description of a preferred arrangement as shown in FIGS. 1–7 will be made with reference to specific work performing means shown in FIG. 1 and identified as a workpiece locating means 110, a first compression means 112, a second compression means 114 and a third compression means 116. For ease of illustration and appreciation or other aspects of the invention in FIG. 1, first and second compression means 112,114 are shown in phantom, it being appreciated that they are identical to third compression means 116 except where otherwise specifically noted hereinafter. In order to accommodate the various work performing means, frame 78 includes a plurality of sets of radially spaced apart openings 126,128 therein. In the preferred arrangement, there are eight (8) such sets which equal the preferred number of work stations. Moreover, the openings of each set are in vertical alignment with an associated work station which thus allows a wide range of flexibility and versatility for the apparatus as to where the particular work performing means may be mounted for association with a particular work station.

Figure 4:
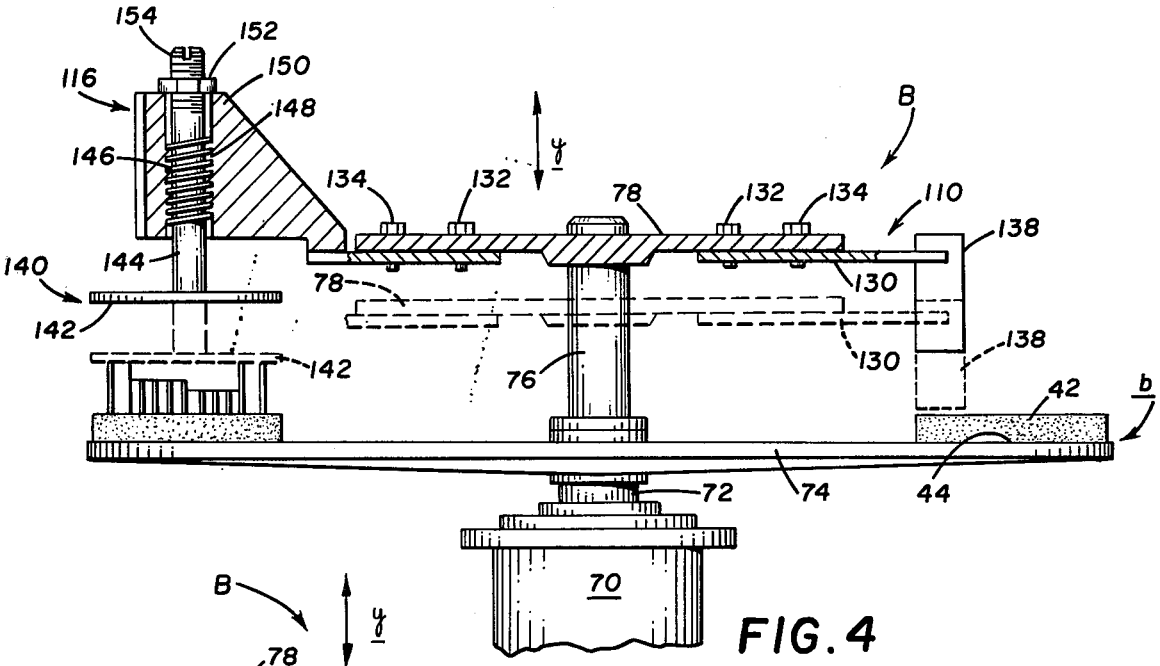
FIG. 4 is a artial cross-sectional view taken along lines 4—4 of FIG. 1.

With reference to FIG. 4, it will be seen that mounting arms generally designated 130 are employed to fixedly mount the work performing means to frame 78. In the view of FIG. 4, workpiece locating means 110 and third compression means 116 are each affixed to an arm 130 which, in turn, are fixedly mounted to frame 78 by means of conventional threaded fasteners 132,134 passing through openings 126,128 in the preselected opening sets and at least into mounting arms 130 themselves.

With regard to workpiece locating means 110 and as best shown in FIGS. 1 and 4, this means comprises a generally V-shaped locate plate generally designated 138 fixedly mounted to the end of the associated mounting arm 130. This V-shaped configuration simply provides a base of reference for a human operator to locate at least one workpiece on a base member b in a manner to be described hereinafter. Also, other shapes and configurations for locate plate 138 can be advantageously employed as may be necessary or desired to accommodate other types and styles of workpieces.

Third compression means 116 includes a compression plate generally designated 140 having a substantially flat compression face 142 which is utilized to apply a compressive force in a manner to be described. An elongated shaft 144 extends outwardly from the rear side of plate 140 and includes a threaded area 146 axially therealong which permits the shaft to be threadedly received and adjusted in threaded bore 148 of compression unit head 150. A lock nut 152 is threadedly received over threaded area 154 adjacent the outermost end of shaft 144 to permit convenient position locking of compression plate 140 in compression unit head 150 once the proper adjustments have been made. The various adjustment features and reasons therefor will be more readily apparent hereinafter. Head 150 itself is conveniently rigidly affixed to the associated mounting arm 130.

Figure 5:
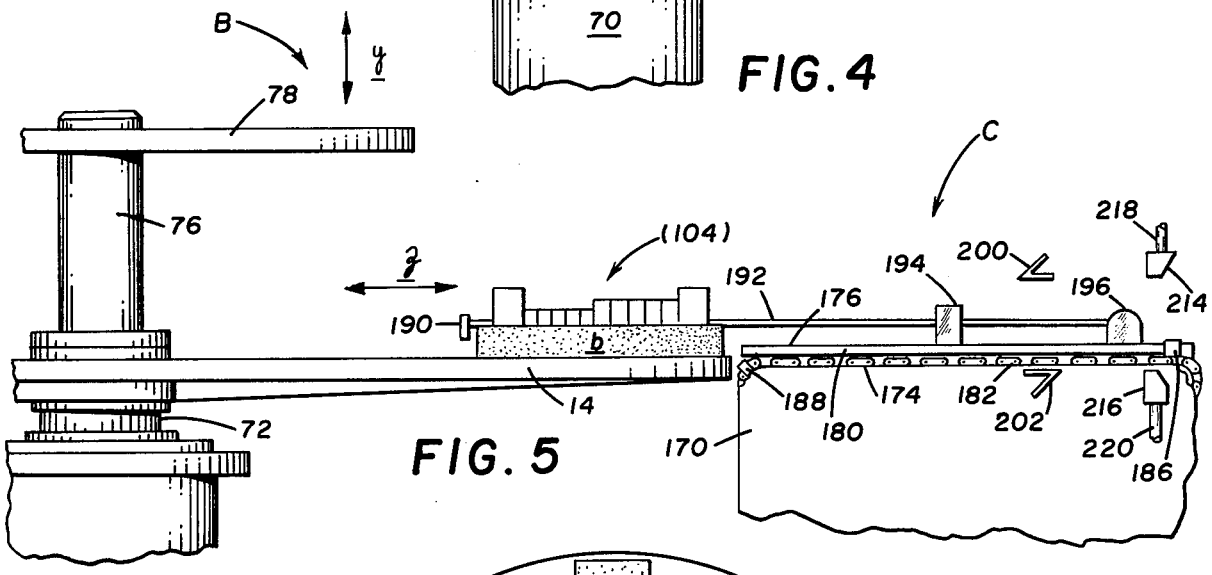
FIG. 5 is a partial cross-sectional view taken along lines 5—5 of FIG. 1.

Referring particularly to FIGS. 1 and 5, description will hereinafter be made with reference to base media ejection unit C. This unit includes a frame/cabinet generally designated 170 somewhat similar to that hereinabove previously described with reference to frame/cabinet 10 and similarly supported by floor or other base. Disposed on planar top wall 174 are a pair of elongated side guides 176,178, each having an L-shaped groove 180 therein with the grooves being disposed in an opposed relationship to each other for defining a base member support channel therebetween. Side guides 176,178 include adjustment means (not shown) to facilitate convenient adjustment of the transverse distance therebetween. A pair of continuous drive chains 182,184 extend longitudinally along top wall 174 between side guides 176,178 and parallel thereto. The chain drive arrangement also includes the necessary end and idler sprockets as is conventional in chain conveyor apparatus. Pairs of chain dogs are associated at spaced intervals with both drive chains and two such pairs are shown in FIG. 5. The chains are selectively driven by conventional drive means (not shown) in the direction z at predetermined intervals for selectively moving the base members and nested workpieces along unit C from adjacent the work path defined by the indexing table B.

In FIG. 5, one pair of chain dogs 188 is shown as disposed immediately below planar top wall 174 so as to not interfere with the initial removal process of the base members from the work path and the other pair of chain dogs 186 is shown as spaced therefrom toward the other end of the unit. As with infeed unit A described above a greater number of chain dog pairs may be required to satisfactorily accommodate the particular chain drive arrangement employed. It should also be here noted that the relative height dimensioning between L-shaped grooves 180, drive chains 182,184 and chain dog pairs 186,188 is substantially similar to the corresponding components discussed hereinabove with reference to feed unit A.

A base member removal arm generally designated 190 in both FIGS. 1 and 5 is utilized to move the base members with nested workpieces from the work path of indexing table B onto removal unit C. Removal arm 190 is disposed to extend across the rear of a base member at work station 104 and has an elongated linkage arm 192 extending from one end thereof back toward unit C. This linkage arm passes through a support bracket generally designated 194 and is interconnected to a drive bracket 196 which, in turn, is drivingly connected through an elongated slot 198 in wall 174 to convenient and conventional drive means (not shown) housed within frame/cabinet 170. The drive means selectively imparts a reciprocal motion to drive bracket 196 in direction z to move the base member and nested workpieces from work station 104 on the conveyor portion of unit C.

Static elimination bars 200,202 are disposed above and below the support channel defined between grooves 180 in much the same manner as bars 50,52 described hereinabove with reference to unit A. Likewise, vacuum heads 214,216 and their associated vacuum tubes 218,220 are disposed further along the support channel in much the same manner as also previously described.

With particular reference to FIGS. 1, 4, 5, 6 and 7, description will hereinafter be made to utilization of the apparatus for nesting three different sizes of engine bearing half shells in a single base member. While the bearing half shells are shown as being located and nested along their peripheral edges, they could also be located and nested along their parting lines. Moreover, the engine bearing half shells are merely an example of one type of workpiece or article which can be packaged by using the concepts of the subject invention. The intent and scope of the invention is in no way limited by the specific example disclosed hereinafter.

First, drive chains 22,24 are energized so that the contact between chain dog pair 28 and the lowermost base member b in magazine 30 will cause the base member to be moved forward from the magazine along the support channel defined between L-shaped grooves 20 toward indexing table B. As the lowermost base member in the magazine is removed therefrom, the remainder of the base members simply dropped by gravity in preparation for similar sequential advancement toward the indexing table.

As base member b moves along the support channel, static electricity therein is removed by upper and lower static elimination bars 50,52 and any foreign material, dirt and the like is removed therefrom by means of upper and lower vacuum heads 54,56. If for some reason a protective coating or the like is desired to be placed on base member top face 42, such coating is applied as the base member passes beneath coating applicator 62.

The nature of the chain drive is such that chain dog pair 28 moves base member b into the base member retaining area 80 which defines initial work station 90. The side plates 82,84 which define each of the retaining areas 80 are all adjusted so as to fairly closely receive base members b therebetween as will be more fully appreciated hereinafter. At the point base member b is moved into initial work station 90, chain dog pair 26 as shown in FIG. 1, or a similar chain dog pair, is moved into the position of chain dog pair 28 as shown in that FIGURE in preparation for advancing the next base member b toward the indexing table.

Figure 6:
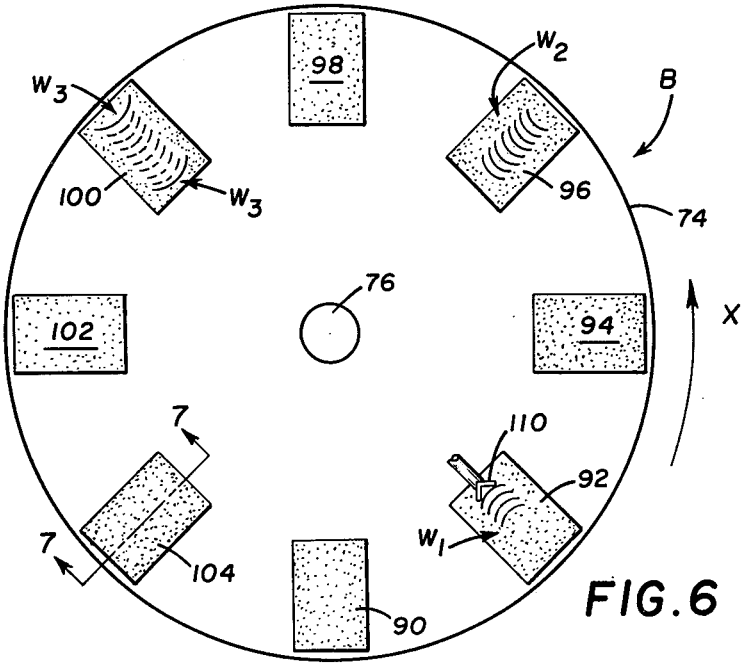
FIG. 6 is a schematic plan view of the indexing table showing the various work stations and nesting progress along the work path for one type of typical nesting operation involving workpieces having different dimensional characteristics.

After base member b has been located between side plates 82,84 of area 80 at work station 90 and with frame 78 in its first or normal position, table 74 is rotated by rotate shaft 72 so that the base member is moved into the position of work station 92. At this point, further rotation is stopped and frame 78 is moved by means of vertical movement shaft 76 from its first position toward its second position as shown in the dashed line position of FIG. 4. In this position, workpiece locating means 110 is moved to a more closely spaced relationship to top face 42 base member b to thereby provide a visual guide for a human operator for placing a plurality of identical engine bearing half shells $w_1$ on the top face as schematically shown in FIG. 6. After a preselected time interval, frame 78 is moved back to its first position as shown in the solid lines of FIG. 4 and table 74 then rotated about rotate shaft 72 until the base member is moved into the position of work station 94.

Figure 7:
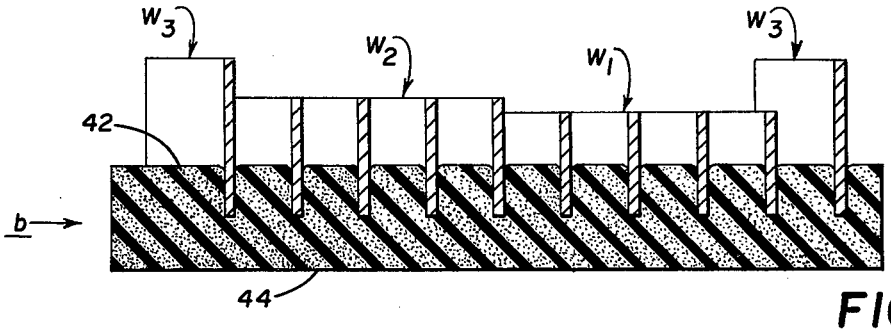
FIG. 7 is a cross-sectional view taken along lines 7—7 of FIG. 6 showing the final nested relationship of three different sizes of workpieces in a single base member.

In this position, the vertical cycle of frame 78 is repeated so that the compression face of first compression means 112 is brought into contact with workpieces $w_1$ in order to force the workpieces into base member b from top face 42 toward bottom face 44 and thereby generate a nested position therefor as shown in FIG. 7. The compression plate of first compression means 112 is adjusted relative to its compression unit head so that workpieces $w_1$ are compressed into the base member a desired distance. Such adjustability is provided as hereinabove described with reference to third compression means 116 by means of the cooperative threaded arrangement between shaft 144 associated with compression plate 140 and compression unit head 150. Again, adjustment is required to make sure that workpieces $w_1$ are nested to the extent desirable within the base member. After compression, frame 78 is moved back to its first position and table 74 rotated so that the base member is moved along the work path to work station 96.

At this work station, there is no corresponding work performing means and a human operator simply places a plurality of second engine bearing half shells $w_2$ which are of a larger size than workpieces $w_1$ on base member top face 42 (FIG. 6) using the position f workpieces $w_1$ as a placement guide. On the next segment of table 74 rotation, the base member is moved to work station 98. When frame 78 is subsequently moved from the first to the second position, compression means 114 engages workpieces $w_2$ to force them into a nested condition in the base member such as shown in FIG. 7 and in a manner similar to that described with reference to the first compression means. Since the bearing half shell workpieces $w_2$ are larger than workpieces $w_1$, second compression means 114 must be adjusted in a manner as described above so that it will not drive workpieces $w_2$ completely through the base member or engage workpieces $w_1$ as workpieces $w_2$ are being nested.

After vertical movement of frame 78 back to its first or normal position, table 74 is further rotated until the base member is located at work station 100. In this work station, there is again no work performing means associated with frame 78 and a human operator simply places workpieces $w_3$ in position on base member top face 42 (FIG. 6) using workpieces $w_1$,$w_2$ as positioning guides. Workpieces $w_3$ are the largest of the three workpiece sizes being nested. Thereafter, the next increment of table 74 rotation moves base member b to work station 102 where third compression means 116 acts upon workpieces $w_3$. Here also, compression plate 140 is adjusted by means of shaft 144 threadedly received in compression unit head 150 so that on the downward stroke of shaft 76 moving frame 78 to the second position workpieces $w_3$ will be compressed into the base member the desired distance without contacting either workpieces $w_2$ or workpieces $w_1$. Table 78 is then returned to the first position.

Thereafter, the next increment of rotation of table 74 in direction x moves the base member to work station 104 which, in the arrangement here under discussion, comprises the exit or final work station. Once at work station 104, and with particular reference to FIGS. 1 and 5, removal unit C is energized. More particularly, the drive means (not shown) associated with drive bracket 196 is energized so as to move base member removal arm 190 on linkage 192 radially outward of indexing table B toward unit C. Removal arm 190 is such that it engages the rear side of base member b and simply pulls it from between the base member retaining area 80 as defined by side plates 82,84 at work station 104 and onto unit C at the support channel defined between L-shaped grooves 180 of elongated side guides 176,178.

Thereafter, the base member removal arm is moved back to the extended position as shown in FIGS. 1 and 5 in preparation for removing the next adjacent base member as it is rotated into work station 104. Also, drive chains 182,184 are energized by their drive means (not shown) and chain dog pair 188 engages the rear edge of the base member to convey it along the support channel in direction z. During this conveying action, the base member and nested workpieces $w_1$, $w_2$ and $w_3$ pass between static elimination bars 200,202 and then between vacuum heads 214,216 for a final cleaning to remove dirt and other foreign material. From that point, the base member and nested workpieces may be removed from unit C for final packaging, storage or the like. At the point of removal, chain dog pair 188 has assumed the position of chain dog pair 186 as shown in FIG. 5 and chain dog pair 186 or another similar chain dog pair has assumed the position formerly held by pair 188 in preparation for conveying the next base member and nested workpieces.

The above description has, of course, been made with reference to one base member b as it moves onto, along and from indexing table B for having a plurality of different workpieces of different sizes being nested thereinto. It should be readily appreciated that the apparatus and method as so described operate in a continuous manner so that a new base member is introduced into work station 90 and a base member having nested workpieces thereon is removed from work station 104 during each segment of table 74 rotation in direction x. By way of example, it is possible in some situations to have the table index between adjacent work stations every five seconds or so assuming nominal operational speeds of the system. However, depending on the complexity of the overall nesting operation to be performed, the number of workpiece sizes involved and so on, this production speed and capacity may vary somewhat.

Nevertheless, the apparatus and method as described above provides a substantial increase in productivity for nesting various types and styles of workpieces in a base member comprised of a permanently deformable material such as cellular polystyrene or the like. An additional benefit derived from the method and apparatus is the degree of versatility which it offers. For example, and again depending upon the specific nature of the workpieces which are to be nested in the base members, fewer than the three compression means 112,114 and 116 may be required. In that event, some increase in productivity may be realized by lessening the human factor involved. Moreover, and because the specifically disclosed work performing means, i.e., means 110,112,114 and 116 and all releasably mounted to frame 78 by means of mounting arms 130 and mechanical fasteners 132,134, the work performing means may be located at different intervals around the frame in operative association with different work stations than has been shown and described above. This then will allow the method and apparatus to be practiced in many different alternative fashions to obtain the ultimate in production capabilities and capacities. It is also possible to at least have unit C associated with a different work station. This may be desirable where the overall nesting operation only requires, for example, three (3) or so of the work stations. Such may be the case where nesting is for a single workpiece or for a plurality of workpieces of the same size.

It is also possible and wholly within the spirit and scope of the present invention to modify the basic components themselves to some degree. For example in this regard, it is possible to adapt infeed unit A to utilize a pneumatic cylinder in place of drive chains 22,24. It is similary possible to utilize a pneumatic cylinder mounted to frame 78 at the exit work station to eliminate use of base member removal arm 190 and its associated structure. Such modifications may be desirable for application with particular workpieces in particular operational environments.

FIG. 7 shows three different engine bearing half shell sizes which were placed on top face 42 of base member b so as to rest and then be nested along a peripheral edge. As previously noted, it is also possible without departing in any way from the overall intent or scope of the present invention to position and nest the half shells into the base member along their parting lines. Again, also, the method and apparatus described above is equally applicable to many parts, articles and the like other than engine bearing half shells which are readily compressible directly into a permanently deformable base member.

The versatility of the present invention is further apparent in that it is readily useable for packaging limited strength items such as medicine bottles and the like which are not directly compressible into the base member. In order to nest such items, it is typically necessary to generate a cavity area in the base member prior to placing the item thereon for nesting purposes. To that end and with reference to FIG. 8, there is shown a cavity forming compression die. For ease of illustration and appreciation of the invention, like components are identified by like numerals with a primed (') suffix and new components are identified by new numerals.

Figure 8:
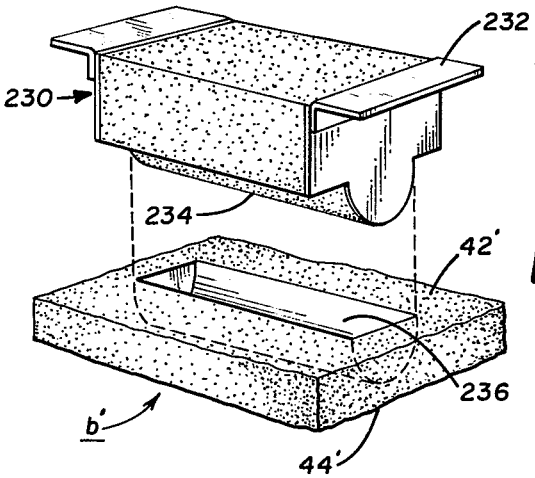
FIG. 8 is a perspective view showing a modified work performing means which may be used in practicing the concepts of the invention.

In FIG. 8, the cavity forming die is generally designated 230 and includes a generally flat base area 232 and a cavity forming area 234. Base area 232 includes a pair of opposed outwardly extending mounting flanges which permit the die to be readily affixed by convenient means to the flat compression face of a compression plate such as that designated 140,142 in third compression means 116 which was described hereinabove and shown in FIG. 4. Die 230 and the remainder of the associated work performing means are mounted to frame 78 along the work path at some desired location such that during operation of the apparatus, movement of the frame from its first to its second position causes cavity forming area 234 to engage top face 42' of base member 4' and compress a cavity area 236 thereinto.

As shown in FIG. 8, cavity area 236 is elongated and has a generally semicircular cross-section adapted to receive a similarly formed workpiece further along the work path. At a subseqent work station, the workpiece is placed on top face 42' over cavity area 236 in order that at a still subsequent work station, a compression means such as that described hereinabove will engage the workpiece and force it directly into cavity 236. In order to obtain a close fitting nested relationship between base member b' and the workpiece, it is desired that at least the width dimension of cavity 236 over the length thereof be slightly less than the width of the workpiece. Thus, the workpiece will be tightly nested into the cavity by some slight additional compression of the base member at the cavity area when the workpiece is actually forced thereinto.

Figure 10:
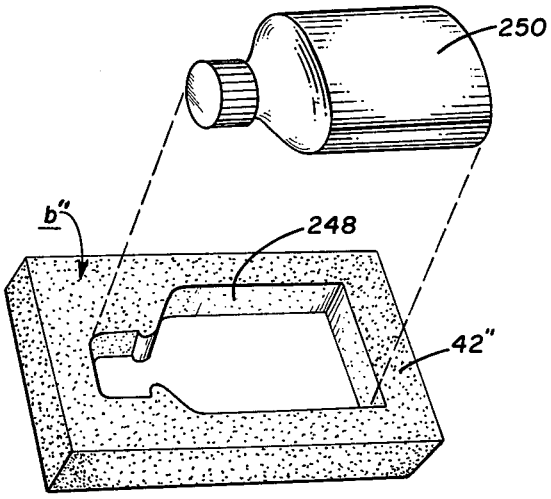
Figure 9:
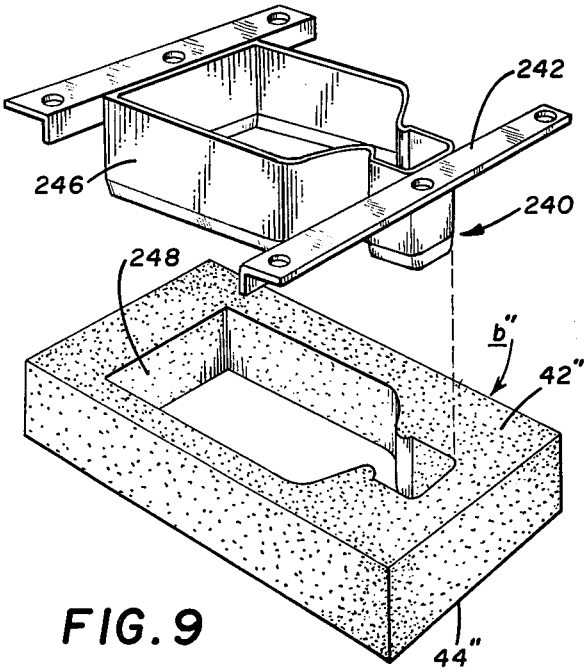
FIG. 9 is a perspective view of a second modified work performing means which may be used in practicing the concepts of the subject invention; and, FIG. 10 is a perspective view of a fragile type of container which is to be nested into a base member and wherein a cavity area therefor has been precut in the base member using the work performing means of FIG. 9.

A still further alternative arrangement is shown with reference to the prospective views of FIGS. 9 and 10. Here again, for items such as medicine bottles or the like which cannot themselves be compressed directly into the base member, a slightly modified form for providing a preformed cavity is shown. Again, for ease of illustration and appreciation of the invention, like components are identified by like numerals with a double primed (") suffix and new components are identified by new numerals.

In FIG. 9, a cavity forming die generally designated 240 is shown which facilitates actually cutting a cavity into base member b" from top face 42" toward bottom face 44" thereof. Cavity forming die 240 includes a base area 242 adapted to facilitate mounting of the die to the compression plate of a compression means similar to that described above with reference to the embodiment of FIG. 8. The die further includes a cavity cutting area or edge 246 depending from base area 242 which is configured to the periphery of the desired cavity area to be cut. When installed on a compression means and properly adjusted relative to the height of base member b", the die will cut a cavity into the base member from top base 42" toward bottom face 44". The cut out portion of the base member is retained inside cavity cutting area or edge 246 on the return frame 78 to its first position and may then be subsequently removed therefrom by convenient knock out means or the like.

FIG. 10 shows cavity 248 in base member b" as having a peripheral outline substantially identical to a medicine bottle, container or the like 250 which is to be inserted thereinto. Such insertion occurs at a subsequent work station along the work path and a compressing action at a still subsequent work station causes container 250 to be forced fully into cavity area 248 for nesting purposes.

As previously noted, the base member material is preferably such that deformation thereof is in a controlled manner. That is, the heavily loaded cells are crushed and permanently deformed while those cells which are loaded to a lesser extent yield elastically and attempt to return to their original position and size. Thus, and with reference to the embodiments of FIGS. 1–10, the lesser loaded cells adjacent the periphery of the workpiece being nested act as springs or grippers to hold and retain the workpieces in the nested position. Such material will also "grow" slightly with age and advantageously more tightly holds the workpieces during handling, shipment and the like. Base members constructed from a cellular urethane foam material are typically preferred since the material exhibits the aforementioned desirable characteristics. However, for some nesting operations, other base member materials may be more advantageously employed to capitalize on their particular physical characteristics.

In the event loose nesting is desired to accommodate extremely frangible or limited strength items, the dimensioning of the dies shown in either FIG. 8 or 9 can be modified so as to generate a cavity slightly larger than the item they are to receive. This then would eliminate the need for any subsequent compression steps.

When using the modifications described above with reference to FIGS 8–10, the overall operation of the method and apparatus are substantially identical to that hereinabove described with reference to FIGS. 1–7, at least insofar as moving the base members onto the indexing unit and removing the base units when nested workpieces therefrom are concerned. However, some changes in the order or the number of work performing means actually utilized may be necessary and/or appropriate and such modifications do not in any way depart from the overall intent or scope of the present invention.

Still further, and in addition to the specific dies shown and described with reference t FIGS. 8 and 9, other types of custom designed work performing means could also be advantageously employed to accommodate specific workpieces and packaging needs. The overall concepts involved would be substantially identical to those already described in detail. Such custom modifications to accommodate special packaging needs and desires do not in any way depart from the overall intent or scope of the present invention.

The invention has been described with reference to the preferred and alternative embodiments. Obviously, modifications and alterations will occur to others upon the reading and understanding of the specification. It is my intention to include all such modifications and alterations insofar as they come within the scope of the appended claims or the equivalents thereof.

Having thus described my invention, I now claim:

1. Apparatus for nesting at least one workpiece in a base member which is comprised of a deformable material having spaced apart generally top and bottom faces, said apparatus comprising:

means defining a work path for supporting said base member at said bottom face and including means for selectively driving said base member sequentially between a plurality of precise work stations disposed at spaced intervals along said work path;

work performing means disposed adjacent said work path at least at selected ones of said work stations and adapted to be selectively moved into and out of a work performing relationship with at least one of said base member and workpiece located at said selected work station for performing nesting operations thereon wherein said work performing means are mounted to frame means which is adapted to be selectively movable generally transverse to the plane defined by said work path between a first nonwork performing relationship spaced from said work path and a second work performing relationship spaced toward said work path from said first relationship for obtaining the ultimately desired nested relationship of said workpiece in said base member; and, means for selectively moving said work performing means into and out of said work performing relationship at least when said base member is located in a work station having one of said work performing means associated therewith.

2. The apparatus as defined in claim 1 further including means for sequentially and separately introducing at least additional base members onto said work path at a first work station as each preceding base member has been moved from said first work station to the next succeeding work station.

3. The apparatus as defined in claim 1 further including means for removing said base member and nested workpiece from said work path at a preselected one of said work stations spaced along said work path from an initial work station.

4. The apparatus as defined in claim 1 wherein said workpiece is initially placed on the top face of said base member and at least one of said work performing means at one of said selected work stations comprises a first compression means adapted to be moved by said moving means from a first non-work performing relationship spaced from said base member and workpiece into a second work performing relationship in contact with at least said workpiece for forcing said workpiece into said base member from said top face toward said bottom face to create a nesting area therefor.

5. The apparatus as defined in claim 4 wherein said first compression means includes means for permitting selective adjustment thereof to vary at least the position of at least said second work performing relationship relative to said base member and workpiece.

6. The apparatus as defined in claim 4 wherein another of said work performing means comprises a second compression means spaced along said work path from said first compression means at another of said selected work stations, said second compression means adapted to be moved by said moving means from a first non-work performing relationship into a second work performing relationship with at least one second workpiece positioned on said base member top face adjacent said workpiece at a point intermediate the work stations associated with said first and second compression means for forcing said second workpiece into said base member from said top face to create a nesting area therefor.

7. The apparatus as defined in claim 1 further including means for positively positioning said base member at least at selected ones of said precise work stations along said work path.

8. The apparatus as defined in claim 7 further including means for locating said at least one workpiece on said base member at one of said work stations prior to nesting of said workpiece in said base member by said work performing means.

9. The apparatus as defined in claim 8 wherein said locating means is selectively movable by said moving means between a first non-locating position spaced from said base member and a second locating position spaced closely adjacent said base member.

10. Apparatus for nesting at least one workpiece in a base member which is comprised of a deformable material having spaced apart generally top and bottom faces, said apparatus comprising:

means defining a work path for supporting said base member at said bottom face and including means for selectively driving said base member sequentially between a plurality of precise work stations disposed at spaced intervals along said work path;

work performing means disposed adjacent said work path at least at selected ones of said work stations adapted to be selectively moved into a work performing relationship with at least one of said base member and workpiece for performing nesting operations thereon wherein at least one of said working performing means at one of said selected work stations comprises a die adapted to be moved from a first non-work performing relationship into a second work performing relationship with said base member wherein at least a portion of said die engages a portion of said base member from said top face toward said bottom face in order to develope a cavity area for receiving said workpiece therein or obtaining the ultimately desired nested relationship of said workpiece in said base member; and, means for selectively moving said work performing means into and out of said work performing relationship at least when said base member is located in a work station having one of said work performing means associated therewith.

11. The apparatus as defined in claim 10 wherein said die comprises a compression type die which compresses a portion of said base member for forming said cavity area therein.

12. The apparatus as defined in claim 10 wherein said die comprises a cutting type die which cuts away a portion of said base member for forming said cavity area therein.

13. The apparatus as defined in claim 10 wherein another of said work performing means comprises compression means spaced along said work path from said die at another of said selected work stations, said compression means adapted to be moved by said moving means from a first non-work performing relationship into a second work performing relationship with said at least one workpiece positioned over said cavity area in said base member intermediate the work stations associated with said die and compression means whereby said workpiece is forced into a nested position in said cavity area by said compression means.

14. Apparatus for nesting at least one workpiece in each of a plurality of base members constructed of a deformable material and having spaced apart generally top and bottom faces, said apparatus comprising:

means for defining a generally circular work path having a plurality of base member receiving and retaining areas disposed at spaced intervals therearound for supporting said base members at the bottom faces thereof;

means for selectively rotating said defining means in order that said work path may be rotated about the center axis thereof between a plurality of work stations disposed at spaced intervals therearound;

work performing means disposed adjacent said circular work path in association with at least selected ones of said work stations and adapted to be selectively moved into and out of work performing relationships with at least one of each said base member and associated at least one workpiece wherein said work performing means are mounted to a frame means which is adapted to be selectively movable generally transverse to the plane defined by said work path between a first non-work performing relationship spaced from said work path and a second work performing relationship spaced toward said work path from said first relationship for obtaining the ultimately desired nested relationship therebetween; and, means for selectively moving said work performing means into and out of said work performing relationship at least when said base members are sequentially moved along said work path into work stations having work performing means associated therewith.

15. The apparatus as defined in claim 14 further including means adjacent said work path at an initial work station for sequentially introducing at least additional base members onto said work path at said initial work station as each preceeding base member has been moved from said initial work station to the next succeeding work station.

16. The apparatus as defined in claim 15 wherein said introducing means includes a base member magazine for storing a plurality of base members for sequential introduction onto said work path at said initial work station.

17. The apparatus as defined in claim 16 wherein said introducing means includes means for preparing said base members for processing as said base members are moved from said magazine toward said initial work station.

18. The apparatus as defined in claim 15 further including means for removing said base member and nested workpiece from said work path at an exit work station spaced along said work path from an initial work station.

19. The apparatus as defined in claim 18 wherein removing means is disposed adjacent said work path at said exit work station, said removing means including means for selectively engaging said base member and pulling it generally radially outward from said work path.

20. The apparatus as defined in claim 14 wherein said workpiece is initially placed on the top face of said base member and at least one of said work performing means comprises a first compression means adapted to be moved into forcing contact with at least said workpiece for forcing said workpiece into said base member from said top face toward said bottom base for creating a nesting area therefor as said frame is moved from said non-work performing relationship into said work performing relationship by said moving means.

21. The apparatus as defined in claim 20 wherein said first compression means includes means for permitting selective adjustment of the distance between said compression means and said workpath at least when said frame is moved to said second work performing relationship.

22. The apparatus as defined in claim 20 wherein another of said work performing means comprises a second compression means mounted to said frame at a position spaced along said work path from said first compression means at another of said selected work stations and adapted to be moved into forcing contact with at least one second workpiece disposed on said base member top face adjacent said workpiece intermediate the work stations associated with said first and second compression means for forcing said second workpiece into said base member from said top face toward said bottom face to create a nesting area therefor when said frame is moved from said non-work performing relationship into said work performing relationship by said moving means.

23. The apparatus as defined in claim 14 further including means for locating said at least one workpiece on said base member at one of said work stations prior to nesting of said workpiece in said base member by said work performing means.

24. The apparatus as defined in claim 23 wherein said locating means is mounted to said frame and selectively movable between a non-locating position spaced from said base member when said frame is in said first non-work performing relationship and a locating position spaced adjacent said base member when said frame is in said second work performing relationship.

25. The apparatus as defined in claim 14 wherein at least one of said work performing means associated with said frame comprises a die adapted to be moved from a non-forming position when said frame is in said first non-work performing relationship and a forming position with said base member when said frame is moved to said second work performing relationship wherein at least a portion of said die engages a portion of said base member from said top face toward said bottom face in order to develop a cavity area for receiving said work piece therein.

26. The apparatus as defined in claim 25 wherein said die comprises a compression type die which compresses a portion of said base member for forming said cavity area therein.

27. The apparatus as defined in claim 25 wherein said die comprises a cutting type die which cuts away a portion of said base member for forming said cavity area therein.

28. The apparatus as defined in claim 25 wherein another of said work performing means comprises compression means operably mounted to said frame at a position spaced along said work path from said die and in association with another of said selected work stations adapted to be moved from a non-contacting relationship when said frame is in said first non-work performing relationship into a contacting relationship with said workpiece when said frame is moved to said work performing relationship, said workpiece being positioned on said base member over said cavity area intermediate the work stations associated with said die and compression means whereby said compression means forces said workpiece into said cavity area.

* * * * *